US008376198B2

(12) United States Patent
Niccol

(10) Patent No.: US 8,376,198 B2
(45) Date of Patent: Feb. 19, 2013

(54) GARMENT HANGER

(75) Inventor: Andrew Niccol, Auckland (NZ)

(73) Assignee: Braitrim Limited, London (GB)

( * ) Notice: Subject to any disclaimer, the term of this patent is extended or adjusted under 35 U.S.C. 154(b) by 636 days.

(21) Appl. No.: 12/596,441

(22) PCT Filed: Apr. 18, 2008

(86) PCT No.: PCT/GB2008/001376

§ 371 (c)(1),
(2), (4) Date: Nov. 25, 2009

(87) PCT Pub. No.: WO2008/129273

PCT Pub. Date: Oct. 30, 2008

(65) Prior Publication Data

US 2010/0108725 A1 May 6, 2010

(30) Foreign Application Priority Data

Apr. 18, 2007 (GB) ..... 0707500.5

(51) Int. Cl.
*A41D 27/22* (2006.01)

(52) U.S. Cl. ..... 223/85; 223/87; 223/88; 223/95; 223/98

(58) Field of Classification Search ..... 223/85, 223/87, 88, 92, 95, 98
See application file for complete search history.

(56) References Cited

U.S. PATENT DOCUMENTS

| | | | | |
|---|---|---|---|---|
| 3,069,009 | A * | 12/1962 | Hoeflich | 223/87 |
| 5,027,945 | A * | 7/1991 | Wilkins | 223/85 |
| 5,413,301 | A * | 5/1995 | Cadman | 223/87 |
| 6,170,679 | B1 | 1/2001 | Frye et al. | |
| 6,349,863 | B1 | 2/2002 | Frye | |
| 6,581,765 | B1 | 6/2003 | Rhyne | |
| 7,500,559 | B2 * | 3/2009 | Kim | 223/87 |
| 7,513,366 | B1 * | 4/2009 | Keating | 206/495 |

FOREIGN PATENT DOCUMENTS

| | | |
|---|---|---|
| GB | 2 041 744 A | 9/1980 |
| GB | Des. 2078267 | 2/1999 |
| GB | Des. 2082497 | 6/1999 |
| JP | 09-143811 | 6/1997 |
| JP | 11-169268 | 6/1999 |
| JP | 2000-37271 A | 2/2000 |

* cited by examiner

*Primary Examiner* — Nathan Durham
(74) *Attorney, Agent, or Firm* — Young Basile

(57) ABSTRACT

A garment hanger (10) for use with a wrapper (20) for packaging one or more garments suspended from the garment hanger includes engagement means (18) for releasably engaging the wrapper during transportation and/or display of the garments suspended from the garment hanger and for releasing the wrapper from the garment hanger for removal of the garments within the wrapper from the garment hanger.

20 Claims, 11 Drawing Sheets

GARMENT HANGER

This invention relates to a garment hanger and in particular to a garment hanger for displaying one or more garments for sale in retail establishment.

Garment hangers are know for display purposes from which one or more garments may be suspended in which the garment or garments, such as pairs of socks, are secured on the garment hanger with a wrap-around card. The wrap-around card secures the garment or garments tidily on the garment hanger during display and at a point of sale the garment or garments and the garment hanger are passed intact to a purchaser. However, once a purchaser has removed the card wrapper and the garments from the garment hanger the purchaser typically has no further use for the garment hanger because the garments are subsequently stored in a drawer or on a shelf rather than on the display garment hanger, and the garment hanger is typically disposed of by the purchaser.

Sock hangers are known from UK Registered Designs GB2082497 and GB2078267 having a member dependent from an arm, or a lower arm, respectively, of the sock hanger. The member comprises a first portion joined at a first end of the first portion to the arm, or lower arm, such that the first portion is at substantially 45° to the arm, and a second portion joined at a first end of the second portion to a second end of the first portion opposed to the first end at substantially 45° to the first portion, such that the second portion is substantially horizontal in use. The member is dimensioned such that the second end of the first portion terminates, in use, substantially at an inner wall of a wrapper wrapped around a sock suspended from the hanger and a second free end of the second portion terminates on a vertical centre line of a rear face of the wrapper. The free end of the second portion is provided with a cylindrical portion on a rear face of the member with a rivet-shaped head for passing through a circular aperture in a centre of the rear face of the wrapper for fixing the sock hanger to the wrapper, with the apparent intention that the sock hanger passes with the complete package to a customer at a point of sale. The sock hanger cannot therefore be recycled or re-used by the retailer or manufacturer.

It is an object of the present invention at least to ameliorate the aforesaid disadvantages in the prior art.

According to the invention there is provided a garment hanger for use with wrapping means arranged for packaging at least one garment suspended from the garment hanger, the garment hanger comprising hanger engagement means arranged releasably to engage cooperating means of the wrapping means during at least one of transportation and display of the at least one garment suspended from the garment hanger and arranged to release the cooperating means of the wrapping means for removal of the at least one garment packaged within the wrapping means from the garment hanger, such that the garment remains within the wrapping means after removal of the garment from the hanger.

Conveniently, the garment hanger comprises an arm over which a garment may be folded for suspension of the garment from the garment hanger, such that on disengagement of the engagement means the arm is slidable from the folded garment to remove the garment and wrapping means together from the garment hanger with the garment wrapped within the wrapping means.

Conveniently, the engagement means comprises hook means for releasably engaging an edge of, or within, a face of the wrapping means.

Optionally, the engagement means comprises hook means dependent from a lowermost arm of the garment hanger for releasably engaging an aperture in the wrapping means.

Optionally, the engagement means comprises hook means for releasably engaging a lower edge of the wrapping means most remote, in use, from the garment hanger.

Optionally, the engagement means comprises a down-turned terminal portion forming hook means dependent from a lowermost arm of the garment hanger for releasably engaging an upper edge of the wrapping means most proximate, in use, the garment hanger.

According to a second embodiment of the invention, there is provided wrapping means for use with a garment hanger for packaging at least one garment suspended from the garment hanger, the garment hanger comprising engagement means for releasably engaging the wrapping means during at least one of transportation and display of garments suspended from the garment hanger and for releasing the wrapping means for removal of the at least one garment within the wrapping means from the garment hanger.

Conveniently, the wrapping means comprises an aperture for releasably engaging hook means dependent from a lowermost arm of the garment hanger.

According to a third embodiment of the invention, there is provided a combination of a garment hanger and wrapping means as described above.

According to a fourth embodiment of the invention, there is provided a method of suspending garments from a garment hanger for subsequent removal of the garment hanger from the garments comprising the steps of: providing a garment hanger comprising engagement means for releasably engaging wrapping means; suspending a garment from the garment hanger to form a suspended garment; wrapping the wrapping means around the suspended garment such the wrapping means releasably engages the engagement means.

Conveniently, the step of suspending a garment from the garment hanger comprises folding the garment over an arm of the garment hanger.

Conveniently, the step of wrapping the wrapping means around the suspended garment comprises passing a card wrapper around the suspended garment and fixing an end portion of the card wrapper to a body portion of the card wrapper.

Advantageously, fixing the end portion to the body portion comprises passing a tab of the end portion through an aperture of the body portion to lock the end portion to the body portion.

According to a fifth embodiment of the invention, there is provided a method of removing a garment hanger from at least one garment suspended from the garment hanger and wrapped by wrapping means removably engaged with the garment hanger for retaining the wrapping means on the at least one garment during display thereof comprising the steps of: disengaging the garment hanger from the engagement means; and removing the garment hanger from the at least one garment such that the at least one garment remains within the wrapping means after removal from the garment hanger.

Advantageously, the method further comprises re-using or recycling the removed garment hanger.

The invention will now be described, by way of example, with reference to the accompanying drawings in which.

In the Figures, like reference numbers denote like parts.

Figure 1:
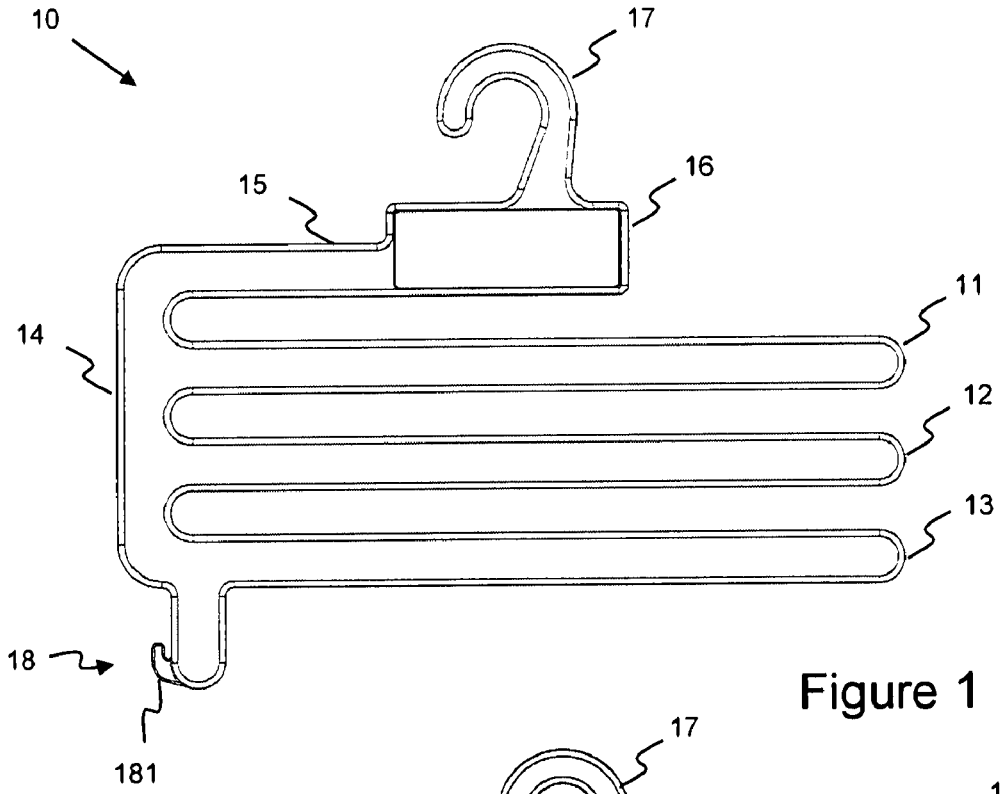
FIG. 1 is a front view of a first embodiment of a garment hanger according to the invention.
Figure 3:
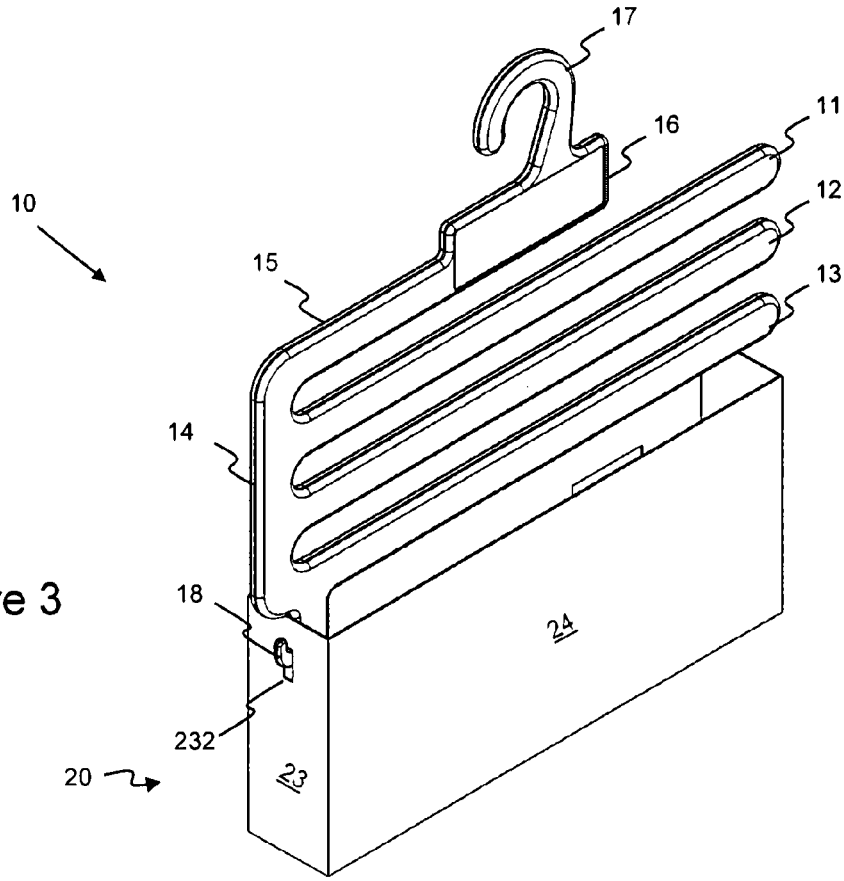
FIG. 3 is a perspective view from the front, top and one side of the garment hanger and card wrapper of FIG. 2.

Referring to FIGS. 1 and 3, a garment hanger 10 according to the invention, suitable for displaying three pairs of boxer shorts, comprises three substantially identical, spaced apart, parallel, garment-bearing elongate arms 11, 12, 13, substantially horizontal in use, each connected at a first respective end thereof to a connecting elongate member 14 which is substantially vertical in use, such that in use the garment-bearing elongate arms are one above the other in a substantially vertical plane. Also extending from the connecting member 14, substantially parallel to the garment-bearing arms and, in use, above an uppermost of the garment-bearing arms 11, is an elongate support member 15 shorter than the garment-bearing arms and terminating in a substantially rectangular label-receiving portion 16, having a lower face collinear with a lower face of the support member 15 and having a major axis parallel thereto. It will, of course, be understood that the support member is not necessarily shorter than the arms or the label-receiving portion necessarily rectangular. Moreover, embodiments of the invention can easily be envisaged which do not have a label-bearing portion. Extending from an upper face of the rectangular label-receiving portion 16, remote from the garment-bearing arms 11-13, and in a plane defined by the garment-bearing arms there is an arcuate support hook 17 such that, in use, a point of contact of the support hook with a support is substantially above a centre of mass of the loaded garment hanger with the garment-bearing arms 11-13 substantially horizontal.

Dependent from a lowermost garment-bearing arm 13 of the garment-bearing arms, and proximate the first end thereof connected to the connecting member 14, there is a hook member 18, in the plane of the garment hanger and facing outward of the garment hanger in a direction towards the connecting member 14.

Figure 2:
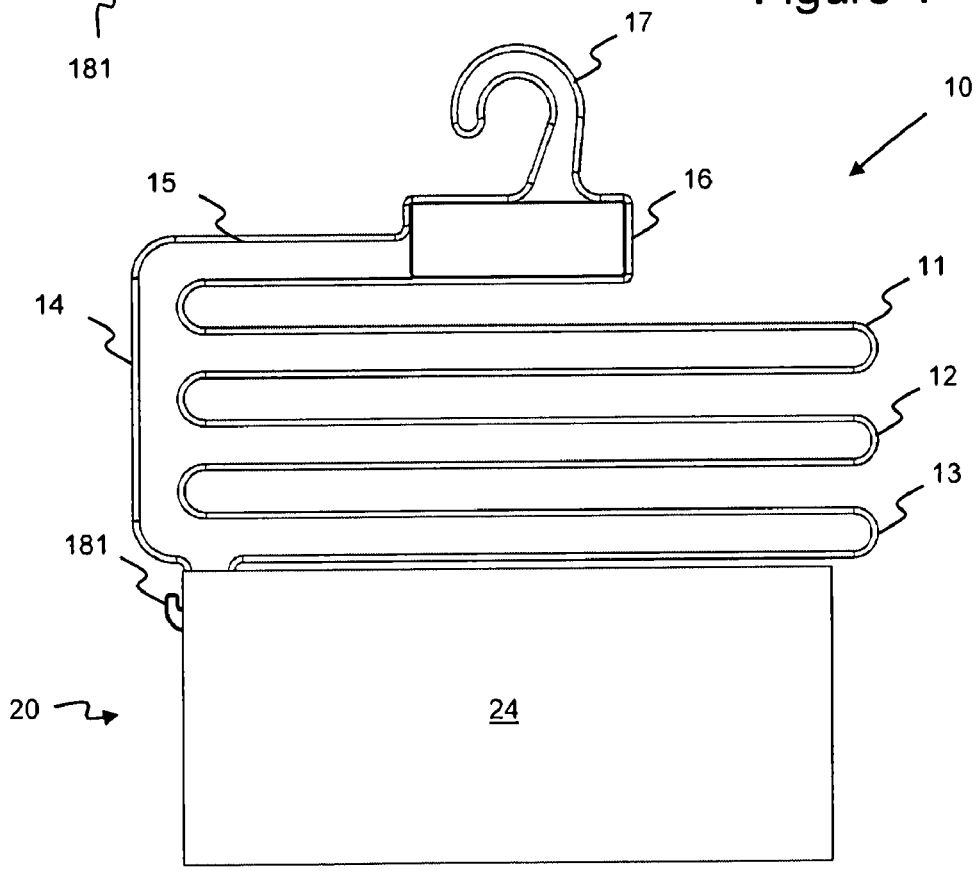
FIG. 2 is a front view of the garment hanger of FIG. 1 with a card wrapper removably fixed to the garment hanger.

Referring especially to FIGS. 2 and 3 there is provided a card wrapper 20 dimensioned to wrap around portions of garments suspended from the garment hanger, which in use around the garments is tubular with a substantially rectangular cross-section. As best seen'in FIG. 3, the card wrapper is provided with a rectangular aperture 232 in an end face 23 of the assembled card wrapper 20, having a major axis parallel to a longitudinal axis of the tubular wrapper and positioned for engagement in use by the hook member 18, and dimensioned such that a vertical, in use, outer portion 181 of the hook member may pass through the aperture 232. Thus the hook means 18 engages an edge of the aperture 232 to retain the wrapper during transportation or display of garments suspended from the garment hanger.

Figure 6:
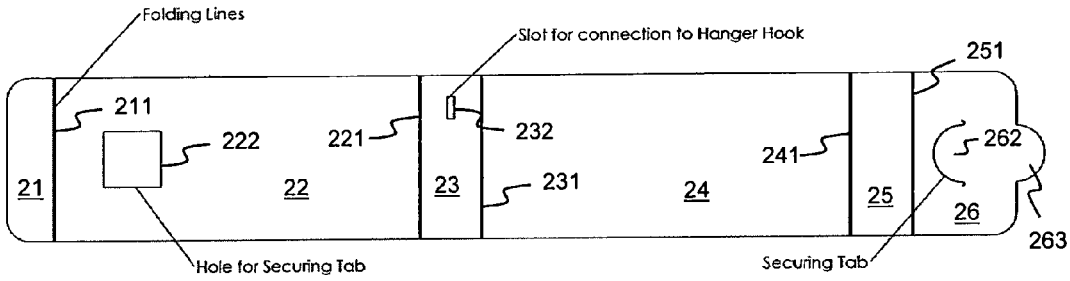
FIG. 6 is a blank of the card wrapper of FIGS. 2 to 5.
Figure 7:
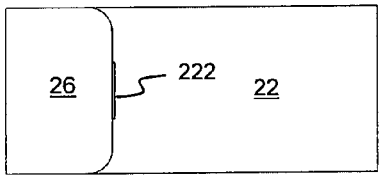
FIG. 7 is a rear view of the blank of FIG. 6 assembled.
Figure 8:
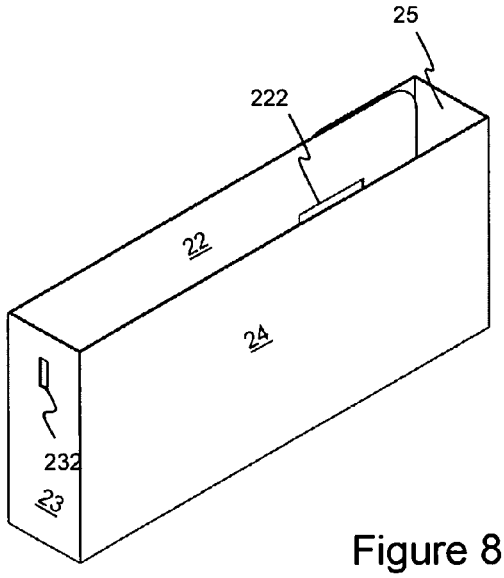
FIG. 8 is a perspective view from the front, top and one side of the blank of FIG. 6 assembled.
Figure 10:
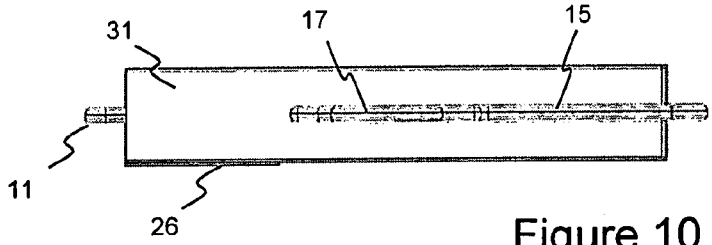
FIG. 10 is a top view to the garment hanger and card wrapper of FIG. 9.

Referring to FIGS. 6 to 8, an elongate blank to be folded to form the card wrapper 20 comprises an inner second end portion 21 joined to a rear portion 22 by a first fold line 211, a first end portion 23 joined to the rear portion 22 by a second fold line 221, a front portion 24 joined to the first end portion 23 by a third fold line 231, an outer second end portion 25 connected to the front portion 24 by a fourth fold line 241 and a tab portion 26 connected to the outer second end portion by a fifth fold line 251.

The tab portion 26 is terminated by a first central hemispherical tab 263 and is provided with a cut-line mirroring and spaced from the tab 263 to form a second tab 262 opposed to the first tab 263.

The rear portion 22 is provided with a substantially square aperture 222 located and dimensioned to cooperate with the first tab 263 and the second tab 262 such that the first and second tab will pass through the apertures when the blank is folded along the fold lines 211, 221, 231, 241 and 251 to lock the tab portion 26 to the rear portion 22, as best shown in FIGS. 7 and 8.

The first end portion 23 is provided with a substantially rectangular aperture 232 having a major longitudinal axis orthogonal to a major longitudinal axis of the blank 20, substantially central of the first end portion 23 and proximate an upper edge thereof. However, in other embodiments the substantially rectangular aperture may be located differently, for example closer to a front face of the wrapper.

Figure 3A:
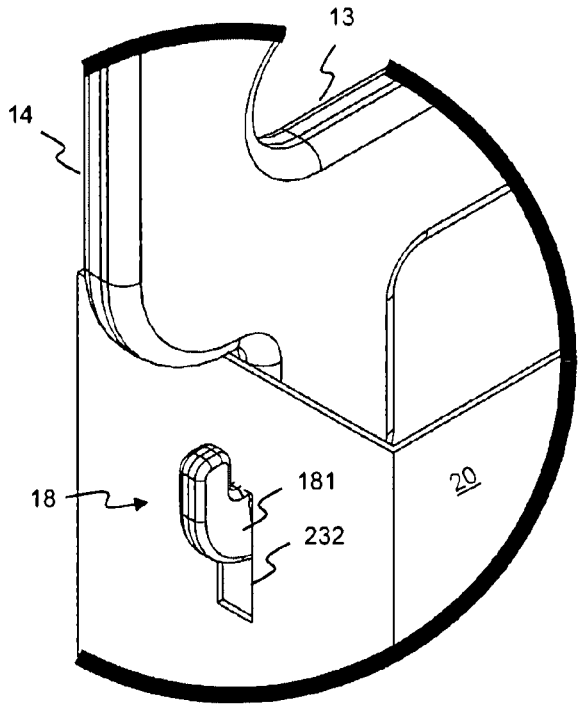
FIG. 3A is an enlarged view of a portion of the garment hanger and card wrapper of FIG. 3 showing the engagement hook on the garment hanger engaging an aperture in the card wrapper.
Figure 4:
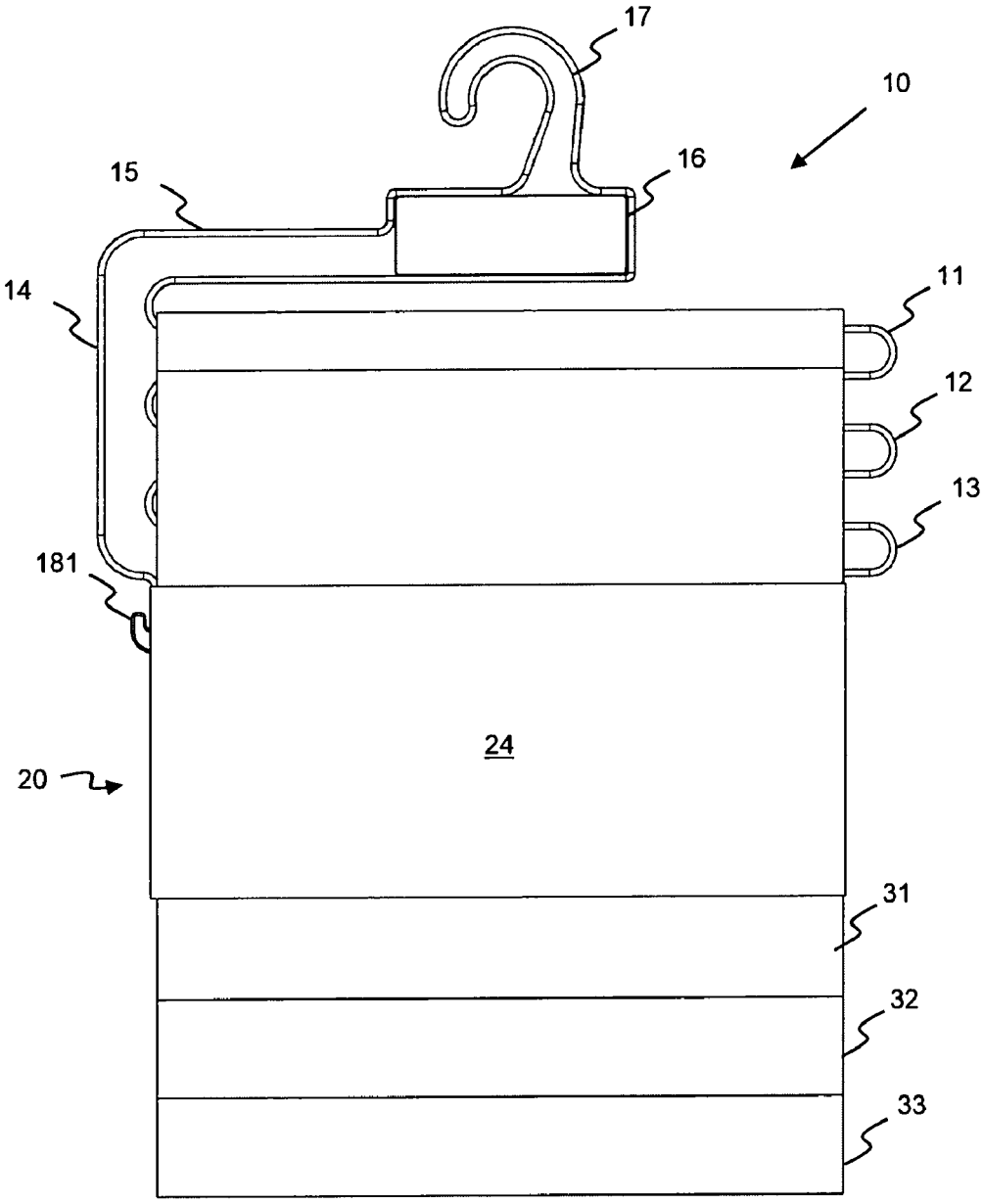
FIG. 4 is a front view of the garment hanger and card wrapper of FIG. 2 with garments suspended from the arms of the garment hanger and wrapped by the card wrapper.
Figure 5:
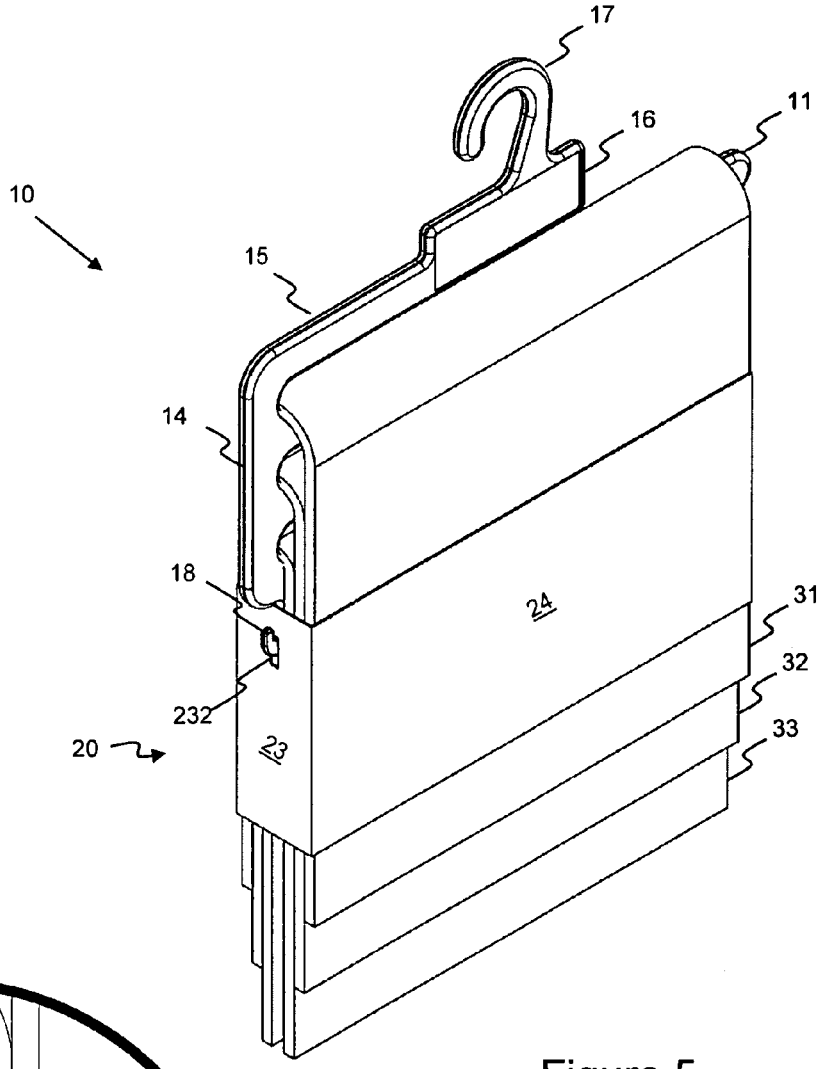
FIG. 5 is a perspective view from the front, top and one side of the garment hanger and card wrapper of FIG. 3 with garments suspended from the arms of the garment hanger and wrapped by the card wrapper.
Figure 5A:
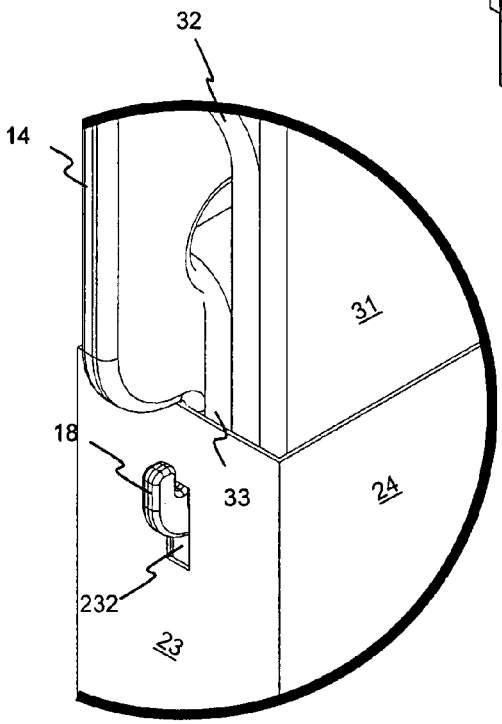
FIG. 5A is an enlarged view of a portion of the garment hanger and card wrapper of FIG. 5 showing the engagement hook on the garment hanger engaging an aperture in the card wrapper and garments suspended form the garment hanger and wrapped by the card wrapper.
Figure 9:
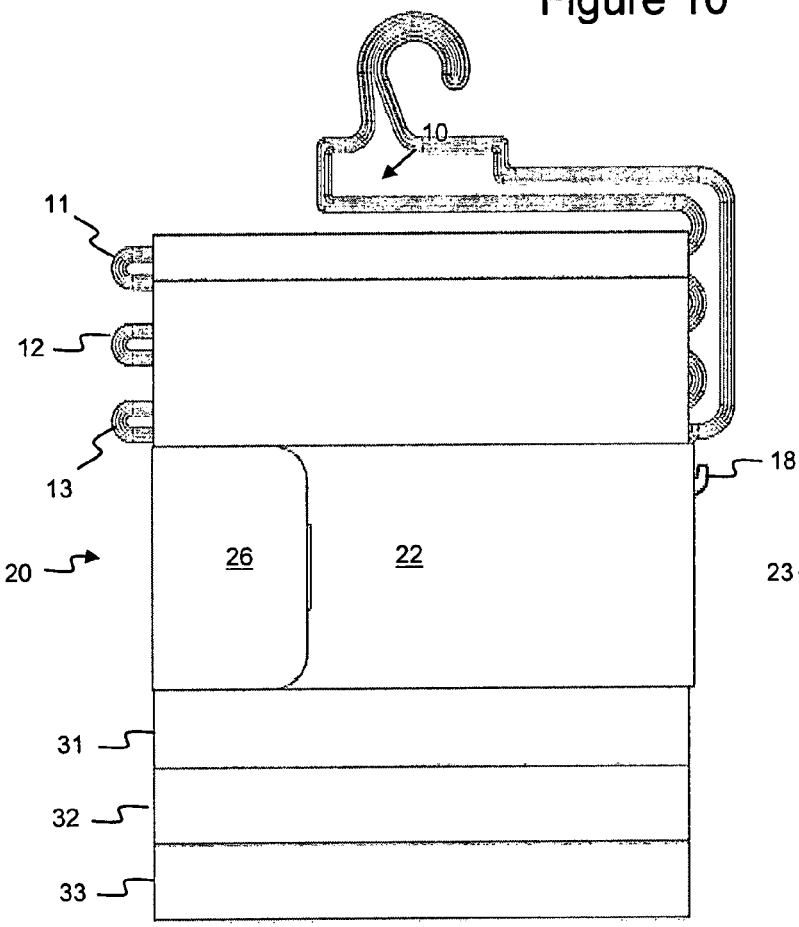
FIG. 9 is a rear view of the garment hanger and card wrapper of FIG. 4 with garments suspended from the garment hanger within the wrapper.
Figure 11:
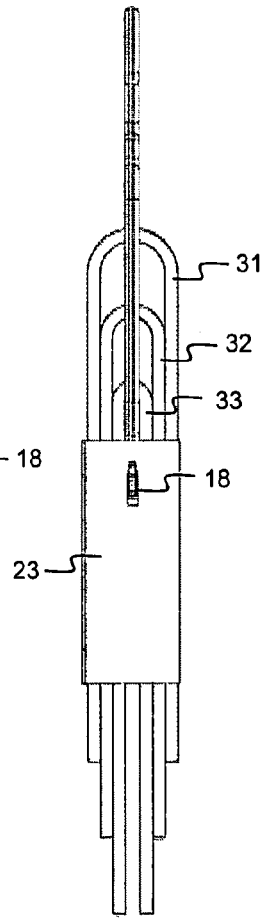
FIG. 11 is an end view to the garment hanger and card wrapper of FIG. 9.
Figure 12:
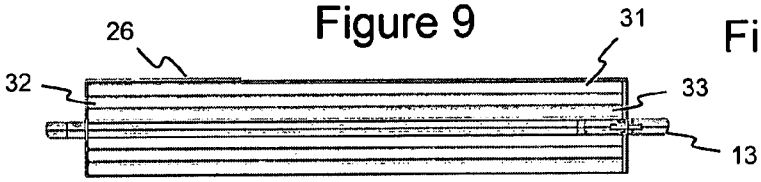
FIG. 12 is an underside view to the garment hanger and card wrapper of FIG. 9.

Referring to FIGS. 4 and 5, in use the garment hanger 10 is loaded by hanging three garments 31-33 over the three garment-bearing arms 11-13 respectively and wrapping the card wrapper 20 around the garments tightly enough to hold the garments together and to retain the card wrapper on the garments, and closed with the tabs 262, 263 passed through the tab aperture 222, as best seen in FIGS. 6 and 7, to lock the wrapper around the garments, with the outer portion 181 of the hook member 18 protruding outwards through the aperture 232. As may best be seen in FIG. 7 and the rear and underside views of FIGS. 9 and 12 respectively, ends of the card wrapper 20 overlap with the terminal tabs passed through the tap aperture 222 in the rear portion 22 of the card wrapper 20. It will be understood that the wrapper may alternatively be fixed around the garments in other ways, for example by other forms of tab or by adhesive or stapling. As best seen in FIG. 3A, without the garments, and in FIG. 5A, with the garments, in this display position the aperture 232 is longer in a vertical direction than a horizontal portion 181 of the hook member 18 on which an upper edge of the aperture rests so that a portion of the aperture 232 extends below the hook member 18.

Figure 13A:
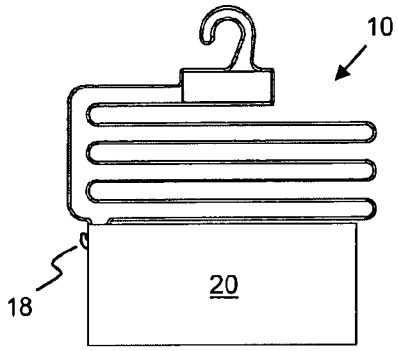
FIG. 13A is a front view of the garment hanger and card wrapper of FIG. 2 with the garment hanger engaged with the card wrapper but shown without garments for greater clarity.
Figure 13B:
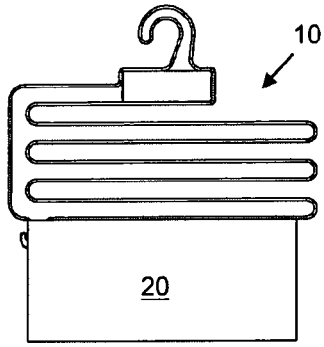
FIG. 13B is the garment hanger and card wrapper of FIG. 13A with the card wrapper raised towards the garment hanger partially to disengage the card wrapper from the garment hanger.
Figure 13C:
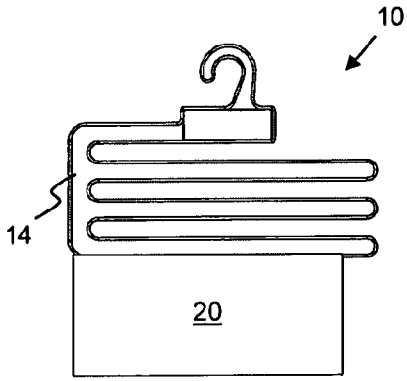
FIG. 13C is the garment hanger and card wrapper of FIG. 13A with the card wrapper moved to the left, as seen in the drawing, with respect to the garment hanger fully to disengage the card wrapper from the garment hanger.
Figure 13D:
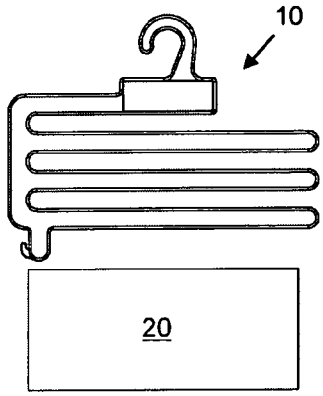
FIG. 13D is the garment hanger and card wrapper of FIG. 13A with the card wrapper lowered with respect to, and in a direction away from, the garment hanger, to allow an engagement hook of the garment hanger fully to clear an upper edge of the card wrapper proximate the garment hanger.
Figure 13E:
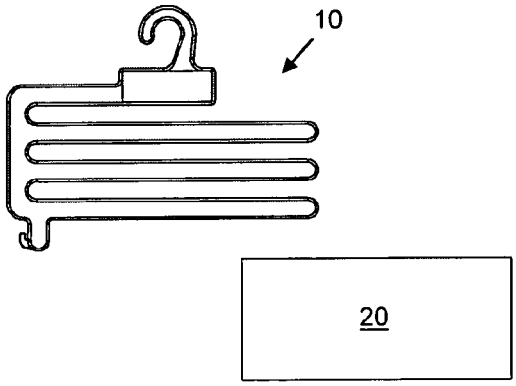
FIG. 13E is the garment hanger and card wrapper of FIG. 13A with the garment hanger slid to the left, as seen in the drawing, with respect to the card wrapper to remove the garment hanger from garments (not shown) wrapped in the card wrapper.

Referring to FIGS. 13A-13E, at, for example, a point of sale or despatch the garments together with the card wrapper are removed from the garment hanger and the garment hanger is recycled or re-used. As shown in FIG. 13B the card wrapper, or at least an end 23 of the card wrapper including the aperture 232, is moved towards the garment hanger 10 and in a direction towards the connecting member 14 as shown in FIG. 13C, so that the hook member 18 re-passes through the aperture 232, temporarily deforming the card wrapper 20 as necessary, to disengage the hook member 18 from the card wrapper 20. The card wrapper in then slid along the garments (not shown) away from the garment hanger 10 sufficiently for a lower face of the hook member 18 to pass over an upper edge of the card wrapper 20. The garment hanger 10 is then slid from the garments leaving the card wrapper 20 wrapped around the garments, and passed to the purchaser as a single package, while the garment hanger 10 is retained by the retail establishment for recycling or re-use.

Figure 15:
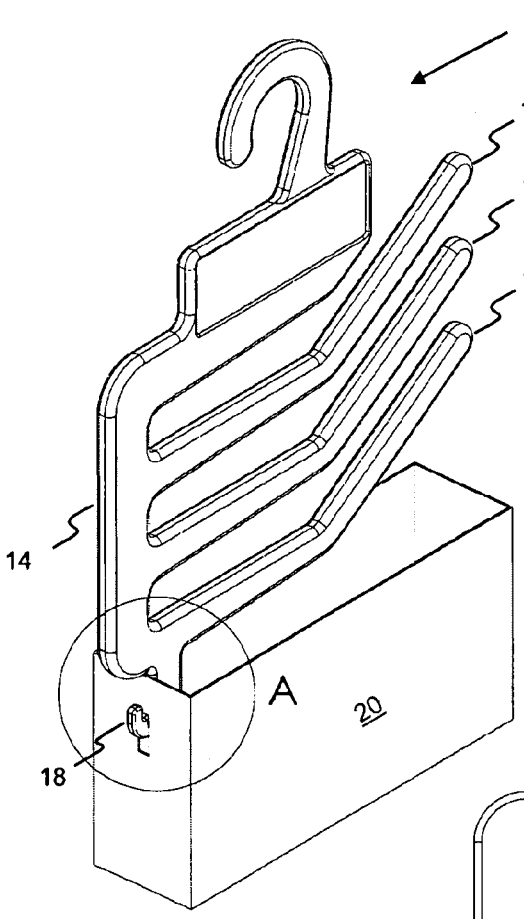
FIG. 15 is a perspective view from the top, front and one side of the garment hanger and card wrapper of FIG. 14, shown without garments.
Figure 15A:
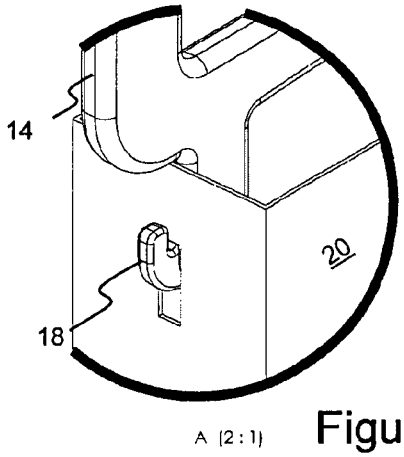
FIG. 15A is an enlarged view of a portion of the garment hanger and card wrapper of FIG. 15, showing an engagement hook of the garment hanger removably engaged with an aperture of the card wrapper.
Figure 14:
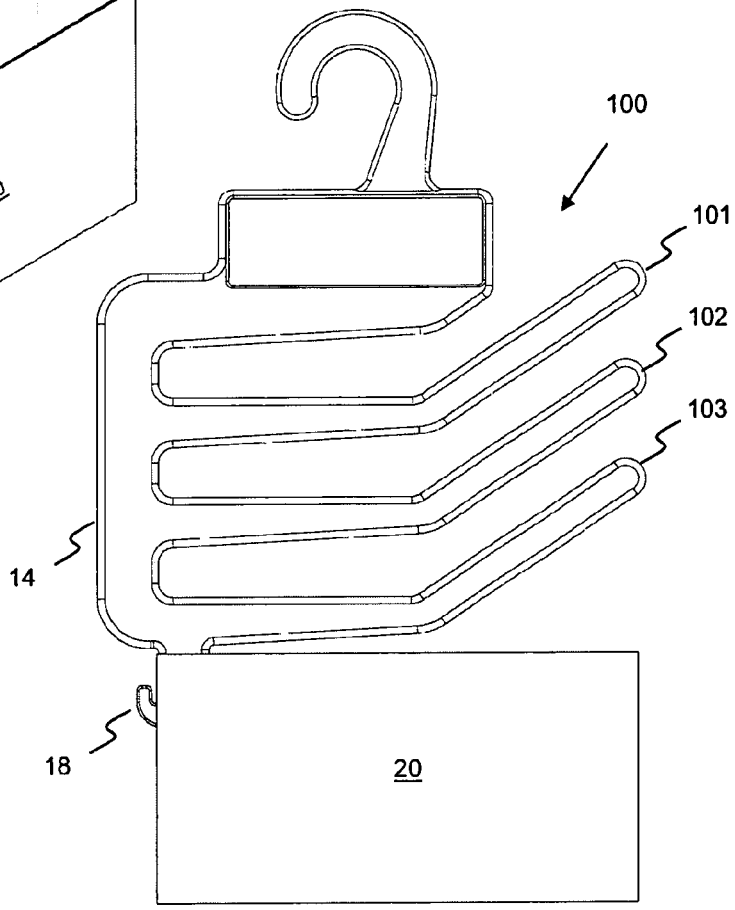
FIG. 14 is a front view of a garment hanger and card wrapper according to the invention, suitable for suspending socks folded at their heels.

Referring to FIGS. 14 and 15, a second embodiment of the invention is a garment hanger 100 suitable for three pairs of socks. The second embodiment of a garment hanger 100 and card wrapper 20 differ from the first embodiment principally in that garment-bearing arms 101, 102, 103 have angled portions remote from a connecting member 14 angled upwards from horizontal portions of the respective garment-bearing arms adjacent to the connecting member 14 to accommodate a heel shape of socks suspended from the garment hanger. It will be understood that in this embodiment some rotation of the garment hanger 100, substantially in a major plane defined by the garment hanger, may be desirable during removal of the garment hanger from the garment/wrapper package to enable withdrawal of the angled portion of the arms from the socks.

Figure 16:
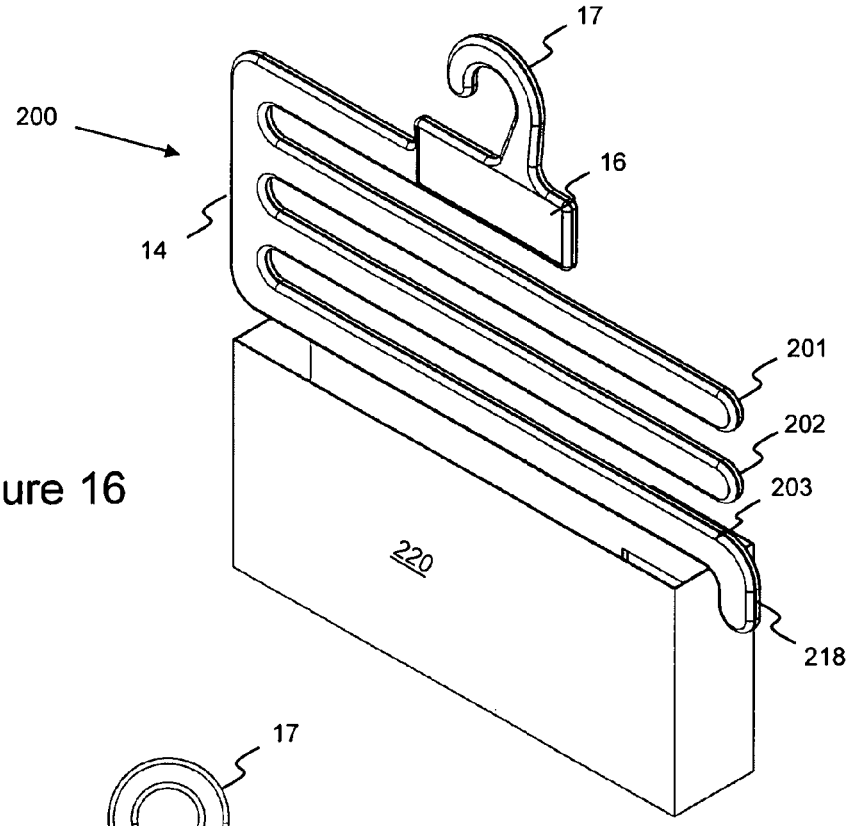
FIG. 16 is a perspective view from the top, front and one side of a second embodiment of a garment hanger and card wrapper according to the invention.
Figure 17:
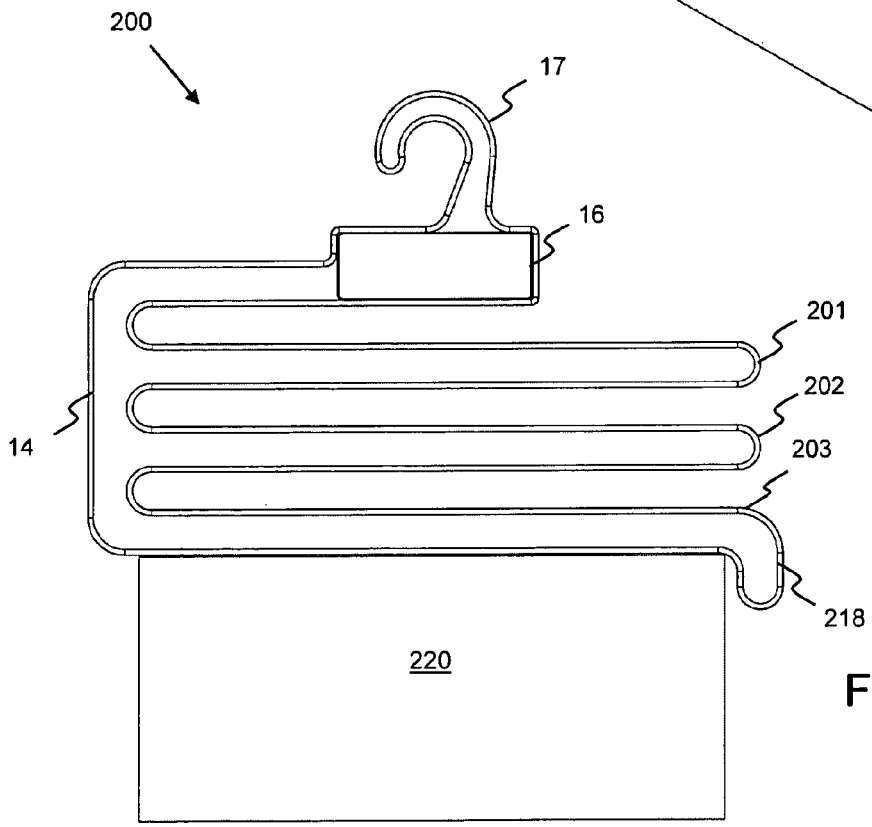
FIG. 17 is a front view of the garment hanger and card wrapper of FIG. 16.
Figure 18:
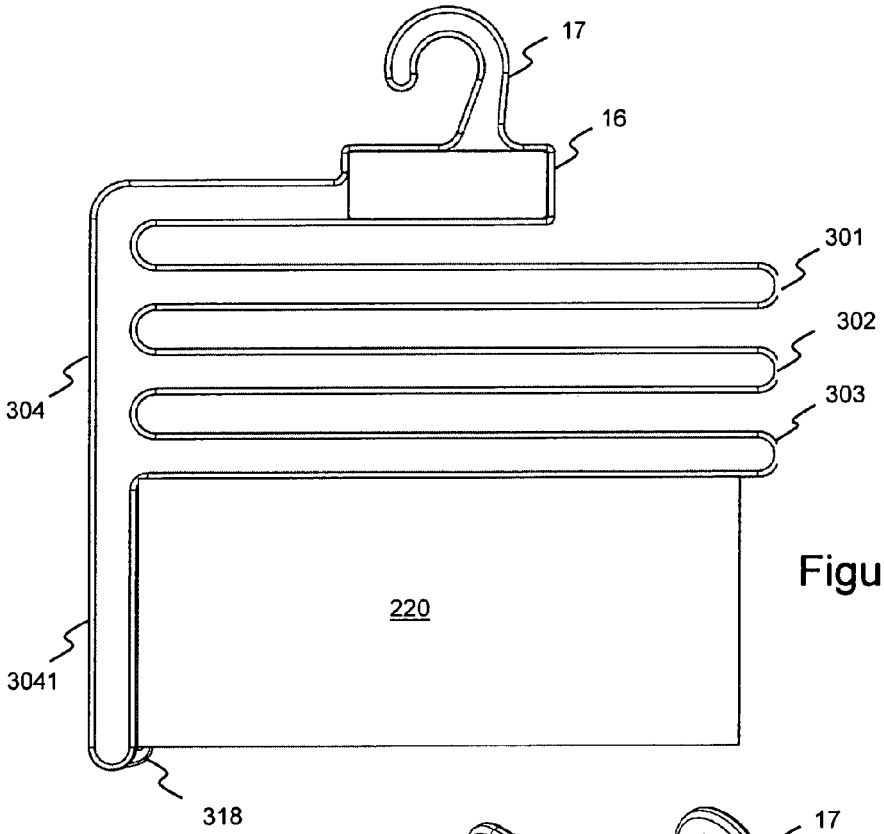
FIG. 18 is a front view of a third embodiment of a garment hanger and card wrapper according to the invention.
Figure 19:
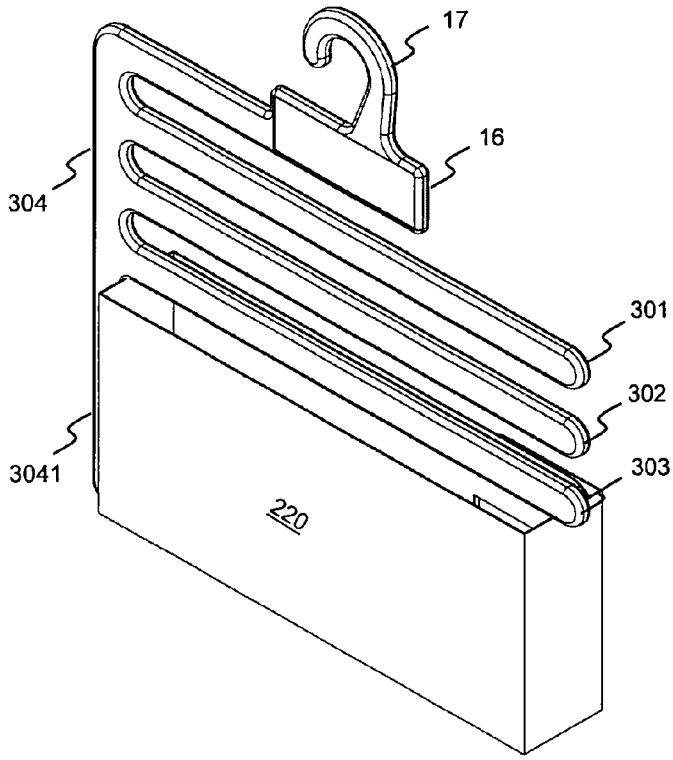
FIG. 19 is a perspective view from the top, front and one side of the garment hanger and card wrapper of FIG. 18.
Figure 20:
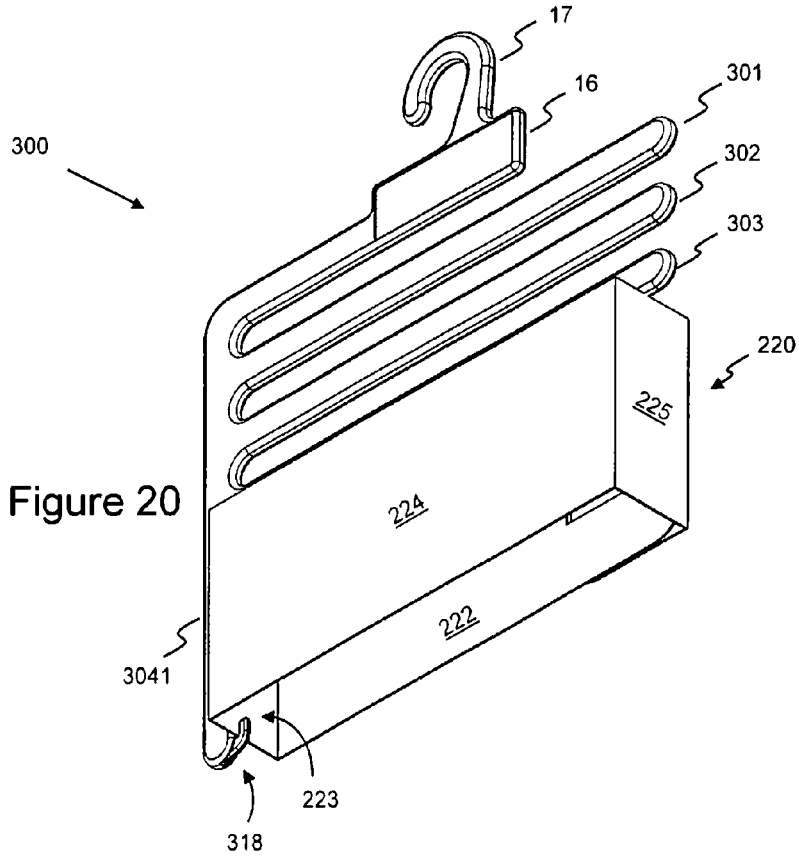
FIG. 20 is a perspective view from the underside, front and one side of the garment hanger and card wrapper of FIG. 18.
Figure 20A:
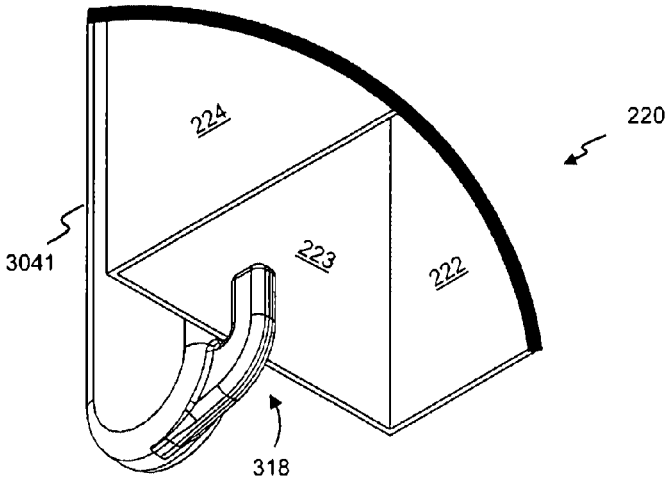
FIG. 20A is an enlarged view of a portion of the garment hanger and card wrapper of FIG. 20, showing an engagement hook of the garment hanger removably engaged with a lower edge of the card wrapper.

Referring to FIGS. 16 and 17, a garment hanger according to a third embodiment of the invention differs from the first and second embodiments in having no separate hook member to engage the card wrapper but instead having three parallel garment-bearing arms 201, 202, 203 in which the lowermost garment-bearing arm 203 terminates at a free end thereof on a down-turned portion 218, overhanging a top edge of the card wrapper 220, sufficiently to prevent the garment being slid from the garments packaged in the card wrapper, without first sliding the card wrapper over the garments away from the garment hanger sufficiently for the down-turned portion 218 to pass over top edges of the card wrapper. Thus the down-turned portion 218 acts as a hook portion for engaging an upper edge of the card wrapper 220. The card wrapper 220 of the present embodiment differs from the card wrapper of the previously described embodiments only in not requiring the hook aperture 232.

Referring to FIGS. 18 to 20A a garment hanger according to a fourth embodiment, having parallel garment bearing arms 301-303, differs from the first embodiment 10 in that the vertical connecting member 304, corresponding to the connecting member 14 of the first embodiment 10, has an extended elongate portion 3041 extending beyond the lowest of the garment-bearing arm 303 to below a lower edge of the card wrapper 220. As best seen in the underside view of FIG. 20, and the enlarged view of FIG. 20A, the extended portion 3041 has a terminal hook member 318 extending in a major plane of the garment hanger 300 to engage, in use, a lower edge of the first end portion 223 of the card wrapper 220. As in the first embodiment, the card wrapper is lifted clear of the hook member 318 before the garment hanger 300 is slid from the garment/wrapper package at a point of sale or despatch.

Thus, in all the embodiments, the garment hanger may be removed at, for example, a point of sale or despatch, without tearing or damaging the card wrapper which remains intact securing the garments together. The card wrapper may therefore be used to transfer information of interest or use to the purchaser.

It will be understood that a garment hanger according to the invention could have fewer or more arms than the three arms in the illustrated embodiments.

It will be further understood that the wrapper is not necessarily of card but could be, for example of paper or plastics material or of recycled card, and can be opaque, translucent or transparent.

It will be further understood that in some embodiments the wrapper may be closed at a bottom face to form packaging such as an open-topped carton more completely to enclose a garment or garments suspended from the garment hanger, provided sufficient relative movement remains possible between the packaging and the garment hanger for the packaging to be disengaged from the garment hanger for delivery of the garment or garments within the packaging.

The invention claimed is:

1. A reusable or recyclable garment hanger for use with wrapping means comprising a wall arranged for wrapping around at least one garment suspended from the garment hanger, the garment hanger comprising hook means arranged releasably to engage an edge of the wall or an edge of an aperture in the wall during at least one of transportation and display of the at least one garment suspended from the garment hanger and arranged to release the edge of the wall or an edge of an aperture in the wall for removal of the at least one garment packaged within the wrapping means from the garment hanger, such that the garment remains within the wrapping means after removal of the garment from the hanger, the garment hanger comprising an arm over which a garment may be folded for suspension of the garment from the garment hanger, such that on disengagement of the hook means the arm is slidable from the folded garment to remove the garment and wrapping means together from the garment hanger with the garment wrapped within the wrapping means.

2. A garment hanger as claimed in claim 1, wherein the hook means is dependent from a lowermost arm of the garment hanger for releasably engaging the edge of the aperture in the wall.

3. A garment hanger as claimed in claim 1, wherein the hook means is arranged for releasably engaging a lower edge of the wrapping means most remote, in use, from the garment hanger.

4. A garment hanger as claimed in claim 1, wherein the hook means comprises a down-turned terminal portion dependent from a lowermost arm of the garment hanger for releasably engaging an upper edge of the wrapping means most proximate, in use, to the garment hanger.

5. Wrapping means for use with a reusable or recyclable garment hanger, the wrapping means comprising a wall for wrapping around at least one garment suspended from the garment hanger, the garment hanger comprising hook means for releasably engaging an edge of the wall or an edge of an aperture in the wall during at least one of transportation and display of garments suspended from the garment hanger and for releasing the wrapping means for removal of the at least one garment within the wrapping means from the garment hanger, the garment hanger comprising an arm over which a garment may be folded for suspension of the garment from the garment hanger, such that on disengagement of the hook means the arm is slidable from the folded garment to remove the garment and wrapping means together from the garment hanger with the garment wrapped within the wrapping means.

6. Wrapping means as claimed in claim 5, wherein the edge of the aperture in the wall releasably engages the hook means, the hook means dependent from a lowermost arm of the garment hanger.

7. Wrapping means as claimed in claim 5, wherein the edge of the wall or the edge of the aperture in the wall is a lower edge of the wrapping means most remote, in use, from the garment hanger.

8. Wrapping means as claimed in claim 5, wherein the edge of the wall or the edge of the aperture in the wall is an upper edge of the wrapping means most proximate, in use, to the garment hanger.

9. A combination of a reusable or recyclable garment hanger and wrapping means comprising a wall arranged for wrapping around at least one garment suspended from the garment hanger, the garment hanger comprising hook means arranged releasably to engage an edge of the wall or an edge of an aperture in the wall during at least one of transportation and display of the at least one garment suspended from the garment hanger and arranged to release the edge of the wall or the edge of the aperture in the wall for removal of the at least one garment packaged within the wrapping means from the garment hanger, such that the garment remains within the wrapping means after removal of the garment from the hanger, the garment hanger comprising an arm over which a garment may be folded for suspension of the garment from the garment hanger, such that on disengagement of the hook means the arm is slidable from the folded garment to remove the garment and wrapping means together from the garment hanger with the garment wrapped within the wrapping means.

10. A combination as claimed in claim 9, wherein the hook means releasably engages lower edge of the wrapping means most remote, in use, from the garment hanger.

11. A combination as claimed in claim 9, wherein the hook means comprises a down-turned terminal portion dependent from a lowermost arm of the garment hanger and releasably engages an upper edge of the wrapping means most proximate, in use, to the garment hanger.

12. A method of suspending at least one garment from a reusable or recyclable garment hanger for subsequent removal of the garment hanger from the at least one garment comprising the steps of:

a. providing a garment hanger comprising hook means for releasably engaging an edge of a wall of wrapping means or of an aperture in the wall of the wrapping means;

b. suspending a garment from the garment hanger to form a suspended garment wherein the step of suspending a garment from the garment hanger comprises folding the garment over an arm of the garment hanger; and c. wrapping the wall of the wrapping means around the suspended garment such that the hook means releasably engages the edge of the wall or the edge of the aperture in the wall.

13. A method as claimed in claim 12, wherein the step of wrapping the wall of the wrapping means around the suspended garment comprises passing a card wrapper around the suspended garment and fixing an end portion of the card wrapper to a body portion of the card wrapper.

14. A method as claimed in claim 13, wherein fixing the end portion to the body portion comprises passing a tab of the end portion through an aperture of the body portion to lock the end portion to the body portion.

15. A method as claimed in claim 12, wherein the edge of the wall or the edge of the aperture in the wall is a lower edge of the wrapping means most remote, in use, from the garment hanger.

16. A method as claimed in claim 12, wherein the hook means comprises a down-turned terminal portion dependent from a lowermost arm of the garment hanger and wherein the edge of the wall or the edge of the aperture in the wall is an upper edge of the wrapping means most proximate, in use, to the garment hanger.

17. A method of removing a reusable or recyclable garment hanger from at least one garment suspended from the garment hanger and wrapped by wrapping means removably engaged with the garment hanger for retaining the wrapping means on the at least one garment during display thereof comprising the steps of:

a. disengaging hook means of the garment hanger from an edge of a wall or an edge of an aperture in the wall of the wrapping means with which the hook means is removably engaged; and b. removing the garment hanger from the at least one garment such that the at least one garment remains within the wrapping means after removal from the garment hanger, the garment hanger comprising an arm over which a garment may be folded for suspension of the garment from the garment hanger, such that on disengagement of the hook means the arm is slidable from the folded garment to remove the garment and wrapping means together from the garment hanger with the garment wrapped within the wrapping means.

18. A method as claimed in claim 17, further comprising re-using or recycling the removed garment hanger.

19. A method as claimed in claim 17, wherein the edge of the wall or the edge of the aperture in the wall is a lower edge of the wrapping means most remote, in use, from the garment hanger.

20. A method as claimed in claim 17, wherein the hook means comprises a down-turned terminal portion dependent from a lowermost arm of the garment hanger and wherein the edge of the wall or the edge of the aperture in the wall is an upper edge of the wrapping means most proximate, in use, to the garment hanger.

* * * * *